US009914127B2

(12) United States Patent
Burhoff et al.

(10) Patent No.: US 9,914,127 B2
(45) Date of Patent: Mar. 13, 2018

(54) HYDRAULIC SYSTEM FOR CONTROLLING A JAW CRUSHER

(71) Applicant: SANDVIK INTELLECTUAL PROPERTY AB, Sandviken (SE)

(72) Inventors: Kristian Burhoff, Staffanstorp (SE); Patrik Sjoberg, Malmo (SE); Andreas Wood, Ystad (SE)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 367 days.

(21) Appl. No.: 14/399,425

(22) PCT Filed: Apr. 26, 2013

(86) PCT No.: PCT/EP2013/058677
§ 371 (c)(1),
(2) Date: Nov. 6, 2014

(87) PCT Pub. No.: WO2013/167393
PCT Pub. Date: Nov. 14, 2013

(65) Prior Publication Data

US 2015/0107232 A1 Apr. 23, 2015

(30) Foreign Application Priority Data

May 10, 2012 (EP) ..... 12167460

(51) Int. Cl.
*F15B 1/02* (2006.01)
*B02C 1/02* (2006.01)
*B02C 1/00* (2006.01)

(52) U.S. Cl.
CPC ..... *B02C 1/025* (2013.01); *B02C 1/005* (2013.01); *F15B 1/021* (2013.01);
(Continued)

(58) Field of Classification Search
CPC ..... F15B 1/021; F15B 11/024; F15B 2011/0243; F15B 2211/3058;
(Continued)

(56) References Cited

U.S. PATENT DOCUMENTS 3,099,406 A 7/1963 Paul
3,386,667 A * 6/1968 May ..... B02C 1/005 241/264

(Continued)

FOREIGN PATENT DOCUMENTS

JP 2007253054 A 10/2007

*Primary Examiner* — Logan Kraft
(74) *Attorney, Agent, or Firm* — Corinne R. Gorski

(57) ABSTRACT

A hydraulic system for controlling the position of a movable jaw of a jaw crusher includes a hydraulic cylinder having a piston with a piston rod for positioning the movable jaw. The hydraulic cylinder has a bore side space for containing a hydraulic fluid taking up crushing forces exerted by the movable jaw on the piston rod, and an annular side space containing a hydraulic fluid pressing the piston against hydraulic fluid of the bore side space. The hydraulic system further includes an annular side space accumulator having a fluid compartment, which is in fluid contact with the annular side space, and a gas compartment containing a pressurized gas applying a pressure on the hydraulic fluid in the annular side space.

16 Claims, 2 Drawing Sheets

(52) U.S. Cl.
CPC ..... *F15B 2211/3058* (2013.01); *F15B 2211/50518* (2013.01); *F15B 2211/55* (2013.01)

(58) Field of Classification Search
CPC ..... F15B 2211/55; F15B 2211/6055; F15B 2211/3133; F15B 2211/50518; B02C 1/005; B02C 1/025; B02C 1/10
See application file for complete search history.

(56) References Cited

U.S. PATENT DOCUMENTS

| | | | | |
|---|---|---|---|---|
| 6,327,956 | B1 * | 12/2001 | Rink | F15B 11/024 91/28 |
| 6,375,105 | B1 * | 4/2002 | Haven | A01F 29/005 241/189.1 |
| 7,124,576 | B2 * | 10/2006 | Cherney | E02F 9/2217 60/414 |
| 8,307,641 | B2 * | 11/2012 | Hanks | E02F 9/2207 60/416 |
| 2006/0202075 | A1 | 9/2006 | Young | |

* cited by examiner

HYDRAULIC SYSTEM FOR CONTROLLING A JAW CRUSHER

RELATED APPLICATION DATA

This application is a § 371 National Stage Application of PCT International Application No. PCT/EP2013/058677 filed Apr. 26, 2013 claiming priority of EP Application No. 12167460.0, filed May 10, 2012.

TECHNICAL FIELD OF THE INVENTION

The present invention relates to a hydraulic system for controlling the position of a movable jaw of a jaw crusher, the hydraulic system comprising at least one hydraulic cylinder having a piston comprising a piston rod arranged on a first side of the piston for positioning the movable jaw.

The present invention further relates to a method of controlling the position of a movable jaw of a jaw crusher.

BACKGROUND ART

Jaw crushers are utilized in many applications for crushing hard material, such as pieces of rock, ore, etc. A jaw crusher has a movable jaw that cooperates with a stationary jaw. Between the jaws a crushing gap is formed. The size of the crushing gap is adjustable by means of a hydraulic cylinder which is connected to the movable jaw. Adjustment of the position of the movable jaw may be carried out to compensate for wear of wear parts and/or to adjust the size of the crushed material.

Occasionally un-crushable objects, sometimes called tramp material, enter the jaw crusher. Un-crushable objects expose the jaw crusher to large forces and will push the movable jaw away from the stationary jaw.

US 2003/0132328 discloses a crusher having a hydraulic cylinder holding the movable jaw in a desired position. When an un-crushable object enters the jaw crusher hydraulic oil is evacuated from the hydraulic cylinder to an accumulator.

SUMMARY OF THE INVENTION

It is an object of the present invention to provide a jaw crusher hydraulic system which is more efficient in controlling the position of the movable jaw, and handling un-crushable objects, compared to the prior art.

This object is achieved by means of a jaw crusher hydraulic system for controlling the position of a movable jaw of a jaw crusher, the hydraulic system comprising at least one hydraulic cylinder having a piston comprising a piston rod arranged on a first side of the piston for positioning the movable jaw, wherein the hydraulic cylinder comprises a bore side space arranged on a second side of the piston, which is opposite to the first side of the piston, for containing a hydraulic fluid taking up crushing forces exerted by the movable jaw on the piston rod during a crushing cycle of the jaw crusher, and an annular side space arranged on the first side of the piston for containing a hydraulic fluid pressing the piston against hydraulic fluid of the bore side space, the hydraulic system further comprising an annular side space accumulator which comprises a fluid compartment, which is in fluid contact with the annular side space, and a gas compartment arranged for containing a pressurized gas to apply a pressure on the hydraulic fluid in the annular side space.

An advantage of this jaw crusher hydraulic system is that the risk of cavitation in the hydraulic cylinder, and in particular in the region of the piston, and piston sealing arrangements, is reduced, thereby increasing the life of the hydraulic cylinder. Cavitation may occur due to high pressure compression of the hydraulic fluid in the bore side space, reducing the volume of the hydraulic fluid in the bore side space, and/or due to minor leakages of hydraulic fluid from the bore side space and/or from the annular side space. In each of these cases a piston may be exposed to cavitation effects, and may be thrown in an oscillating manner between the hydraulic fluid in the bore side space and the hydraulic fluid in the annular side space. The annular side space accumulator solves, at least partly, the problem of cavitation by providing hydraulic fluid under pressure to, at least partly, compensate for the compression of the hydraulic fluid of the bore side space and/or the minor leakages of hydraulic fluid, such that the piston is, during both the crushing cycle and the retraction cycle of the jaw crusher, firmly pressed between the hydraulic fluid in the bore side space and the hydraulic fluid in the annular side space.

According to one embodiment the hydraulic system further comprises a transfer pipe fluidly connecting the bore side space to the annular side space. An advantage of this hydraulic system is that hydraulic fluid can be transferred to the annular side space from the bore side space when the volume of hydraulic fluid in the bore side space is reduced. This further reduces the risk of under-pressure zones being formed in the annular side space.

According to one embodiment a maximum load pressure relief valve is arranged in the transfer pipe to open a connection from the bore side space to the annular side space when a first predetermined pressure of the hydraulic fluid in the bore side space is exceeded. An advantage of this embodiment is that connection between the bore side space and the annular side space is established only when needed, i.e., when hydraulic fluid is to be drained from the bore side space.

According to one embodiment a drain pipe fluidly connects the annular side space to a hydraulic fluid tank. An advantage of this embodiment is that any hydraulic fluid not finding place in the annular side space, because, for example, a flow of hydraulic fluid from the bore side space being larger than a simultaneous increase in the volume of the annular side space, and/or the volume of the annular side space being reduced, can be drained from the annular side space without interfering with the bore side space.

According to one embodiment an annular side pressure relief valve is arranged in the first drain pipe to open a connection from the annular side space to the hydraulic fluid tank when a second predetermined pressure of the hydraulic fluid in the annular side space is exceeded. An advantage of this embodiment is that the pressure in the annular side space can be kept substantially constant, at the second predetermined pressure, when hydraulic fluid is supplied to the annular side space from the bore side space, or when the volume of the annular side space is reduced.

According to one embodiment a pressure relief setting of the maximum load pressure relief valve is at least a factor 5 higher than a pressure relief setting of the annular side pressure relief valve. An advantage of this embodiment is that most of the pressure of the bore side space is used, during a crushing cycle of the jaw crusher, for crushing, and only a minor portion of the pressure of the bore side space is counteracted by the pressure of the annular side space.

According to one embodiment, the pressure relief setting of the annular side pressure relief valve is higher than that pressure with which the piston compresses the hydraulic fluid in the annular side space during a retraction cycle of the crusher. An advantage of this embodiment is that the hydraulic fluid of the annular side space presses the piston towards the hydraulic fluid of the bore side space also during the retraction cycle, thereby minimizing the risk of cavitation.

According to one embodiment the pressure relief setting of the annular side pressure relief valve is in the range of 3 to 50 bar(a), more preferably 5 to 40 bar(a), and most preferably 10 to 30 bar(a). An advantage of this embodiment is that these relief setting pressures of the annular side pressure relief valve have been found suitable for ensuring that the piston is always firmly pressed between the hydraulic fluid of the bore side space and the hydraulic fluid of the annular side space with little or no risks of under-pressure or cavitation occurring in either of the two spaces. Furthermore, most of the pressure of the bore side space is used as crushing pressure, and only a limited portion of the pressure of the bore side space is spent for counteracting the pressure of the annular side space.

According to one embodiment the fluid compartment of the annular side space accumulator has a volume, at a fluid pressure in the annular side space accumulator which is two times the pre-compression pressure of the gas compartment of the annular side space accumulator, of 1 to 20%, more preferably 2 to 10%, of the maximum hydraulic fluid volume of the bore side space. An advantage of this embodiment is that a relatively small accumulator has a lower investment and maintenance cost. Since the accumulator does not take up any substantial volumes of hydraulic fluid during tramp release events, the volume of hydraulic fluid in the accumulator need only be sufficient for compensating for the minor volume changes that may occur as an effect of the varying pressures to which the hydraulic fluid of the bore side space is exposed, and the minor leakages of hydraulic fluid that may occur.

A further object of the present invention is to provide an improved method of controlling a jaw crusher.

This object is achieved by a method of controlling the position of a movable jaw of a jaw crusher comprising at least one hydraulic cylinder having a piston comprising a piston rod arranged on a first side of the piston for positioning the movable jaw. The method comprises supplying hydraulic fluid to a bore side space arranged on a second side of the piston, which is opposite to the first side of the piston, to take up crushing forces exerted by the movable jaw on the piston rod during a crushing cycle of the jaw crusher, and supplying hydraulic fluid to an annular side space arranged on the first side of the piston to press the piston against the hydraulic fluid of the bore side space, and applying a pressure to the hydraulic fluid of the annular side space by an annular side space accumulator which comprises a gas compartment containing a pressurized gas, and a fluid compartment, which is in fluid contact with the annular side space.

An advantage of this method is that the risk of cavitation in the hydraulic cylinder is reduced. Furthermore, the risk is reduced that the piston is thrown in an oscillating manner between the hydraulic fluid of the bore side space and the hydraulic fluid of the annular side space.

According to one embodiment the method further comprises transferring hydraulic fluid from the bore side space to the annular side space. An advantage of this embodiment is that the annular side space may be quickly filled with hydraulic fluid without having to pump hydraulic fluid from a tank. Hence, liquid may be transferred directly from the bore side space to the annular side space with the motive force being the pressure of the hydraulic fluid of the bore side space.

According to one embodiment the method comprises transferring hydraulic fluid from the bore side space to the annular side space when the pressure of the hydraulic fluid in the bore side space exceeds a first predetermined pressure. An advantage of this embodiment is that the transferring of hydraulic fluid from the bore side space to the annular side space is controlled to occur only when needed.

According to one embodiment the method comprises transferring hydraulic fluid from the bore side space to the annular side space when an uncrushable object has been fed to the jaw crusher. An advantage of this embodiment is that the very quick pressure changes and drain procedures coupled to un-crushable objects, for example in tramp release events, can be handled effectively, and hydraulic fluid can be transferred rapidly to the annular side space, thereby avoiding any under-pressure situations in the annular side space. Furthermore, the retraction of the movable jaw in the tramp release event can be made at a higher speed, when there is no under-pressure in the annular side space holding back the piston.

According to one embodiment the method comprises transferring hydraulic fluid from the annular side space to a hydraulic fluid tank when the pressure in the annular side space exceeds a second predetermined pressure. An advantage of this embodiment is that the pressure in the annular side space can be maintained at a rather constant level.

According to one embodiment the second predetermined pressure at which hydraulic fluid is transferred from the annular side space to the hydraulic fluid tank is in the range of 3 to 50 bar(a), more preferably 5 to 40 bar(a), and most preferably 10 to 30 bar(a). The second predetermined pressure determines the hydraulic fluid pressure of the annular side space, and a pressure in the range of 3 to 50 bar(a) has been found suitable for avoiding any under-pressures in the bore side space, and still using only a minor portion of the pressure of the bore side space for counteracting the pressure of the annular side space rather than for crushing pressure.

According to one embodiment the method comprises receiving 40-80%, more preferably 50-80%, of an amount of hydraulic fluid leaving the bore side space in the annular side space. An advantage of this embodiment is that a large portion of the hydraulic fluid that is pressed out of the bore side space in, for example, a tramp release event, is forwarded to the annular side space. This reduces the amount of hydraulic fluid that is directed to a hydraulic fluid tank, making the retraction of the movable jaw quicker during the tramp release event, and reducing problems of oil splashing in the tank.

According to one embodiment the method comprises supplying hydraulic fluid to the annular side space until the pressure in the annular side space is equal to the second predetermined pressure, prior to starting operation of the crusher. In this way the annular side space is pressurized to a well-defined and suitable pressure prior to starting operation of the crusher.

According to one embodiment the method comprises supplying hydraulic fluid to the bore side space after an uncrushable object has left the jaw crusher to return the movable jaw to a desired position, wherein the supply of hydraulic fluid to the bore side space causes a transfer of hydraulic fluid from the annular side space to the tank. An advantage of this embodiment is that crushing operation may start quickly after a tramp release event. Further objects and features of the present invention will be apparent from the description and the claims.

BRIEF DESCRIPTION OF THE DRAWINGS

The invention will hereafter be described in more detail and with reference to the appended drawings.

DETAILED DESCRIPTION OF PREFERRED EMBODIMENTS OF THE INVENTION

Figure 1:
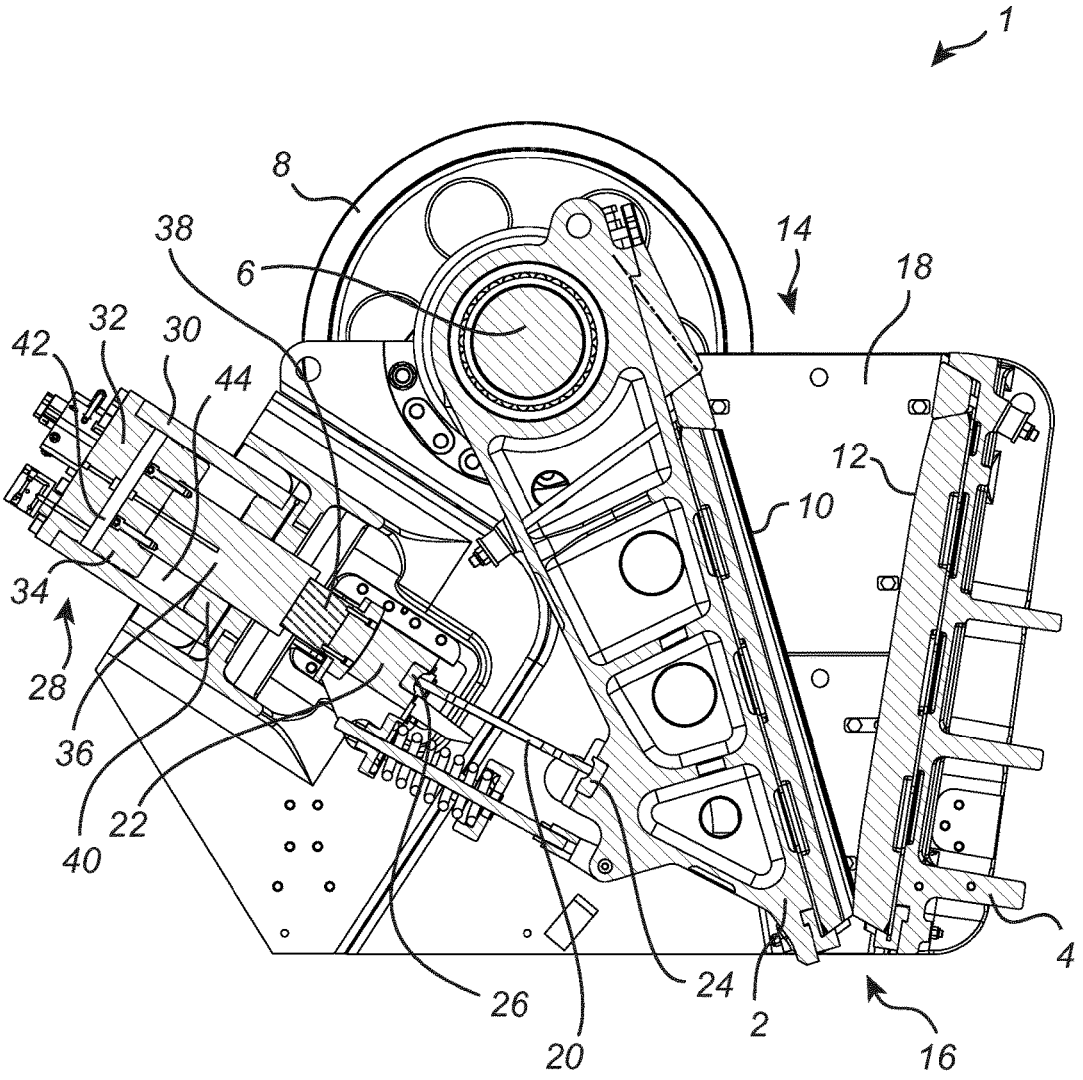
FIG. 1 is a cross-section and illustrates, schematically, a jaw crusher.

FIG. 1 is a cross-section and illustrates, schematically, a jaw crusher 1. The jaw crusher 1 comprises a movable jaw 2 and a stationary jaw 4 forming between them a variable crushing gap. The movable jaw 2 is driven by an eccentric shaft 6 which causes the movable jaw 2 to move back and forth, up and down relative to the stationary jaw 4.

The inertia required to crush material fed to the jaw crusher 1 is provided by a weighted flywheel 8 operable to move the eccentric shaft 6 on which the movable jaw 2 is mounted. A motor (not shown) is operative for rotating the flywheel 8. The movable jaw 2 is provided with a wear plate 10 and the stationary jaw 4 is provided with a wear plate 12. The movement of the eccentric shaft 6 thus causes an eccentric motion of the movable jaw 2, wherein each revolution of the eccentric shaft 6 generates one crushing cycle, during which the movable jaw 2 moves towards the stationary jaw 4 and crushes material against the stationary jaw 4, and one retraction cycle, during which the movable jaw 2 is retracted from the stationary jaw 4 to allow more material to enter between the jaws 2, 4. Material to be crushed is fed to an intake 14 for material to be crushed. The crushed material leaves the crusher via an outlet 16 for material that has been crushed. The jaws 2, 4 are further apart from each other at the material intake 14 than at the material outlet 16, forming a tapered crushing chamber 18 so that the material is crushed progressively to smaller and smaller sizes as the material travels downward towards the outlet 16, until the material is small enough to escape from the material outlet 16 at the bottom of the crushing chamber 18.

The jaw crusher 1 comprises a toggle plate 20, a toggle beam 22, a first toggle plate seat 24 arranged at the lower end of the movable jaw 2 and a second toggle plate seat 26 arranged along a front edge of the toggle beam 22. The toggle plate 20 is seated between the first and second toggle plate seats 24, 26.

The jaw crusher 1 comprises a hydraulic cylinder 28 for positioning the movable jaw 2 to a desired position, i.e. to a desired closed side setting. By "closed side setting" is meant the shortest distance between the wear plate 10 of the movable jaw 2 and the wear plate 12 of the stationary jaw 4. For instance, the hydraulic cylinder 28 can be used to adjust the position of the movable jaw 2 to compensate for wear of the wear plates 10, 12. Furthermore, the hydraulic cylinder 28 may also be used for adjusting the position of the movable jaw 2 to adapt the jaw crusher 1 for crushing various types of materials, and to obtain various average sizes of the crushed material.

The hydraulic cylinder 28 is a double-acting hydraulic cylinder and comprises a cylinder barrel 30, a cylinder base cap 32 mounted on the cylinder barrel 30, a piston 34 arranged to move inside the cylinder barrel 30, a piston rod 36 connecting the piston 34 to the toggle beam 22, via a piston rod head member 38, and a cylinder front cap 40. In the embodiment illustrated in FIG. 1 the hydraulic cylinder 28 is mounted to the jaw crusher 1 via the cylinder front cap 40. In accordance with alternative embodiments the hydraulic cylinder 28 could be mounted to the crusher 1 via the cylinder base cap 32 or via the cylinder barrel 30.

The double-acting hydraulic cylinder 28 comprises a bore side space 42 for hydraulic fluid, and an annular side space 44 for hydraulic fluid. The bore side space 42 is defined by the cylinder barrel 30, the cylinder base cap 32 and the piston 34. The forces occurring during the crushing cycle of the jaw crusher 1, i.e., when the movable jaw 2 moves towards the stationary jaw 4, will be taken up by hydraulic fluid contained in the bore side space 42. The hydraulic pressure inside the bore side space 42 may peak at, for example, 250 bar(a), with "bar(a)" meaning absolute pressure, or more during the crushing cycle.

The annular side space 44 is defined by the cylinder barrel 30, the cylinder front cap 40, the piston 34, and the piston rod 36. During the retraction cycle of the jaw crusher 1, i.e., when the movable jaw 2 moves away from the stationary jaw 4, the hydraulic fluid contained in the annular side space 44 will assist in moving the movable jaw 2 away from the stationary jaw 4.

Figure 2:
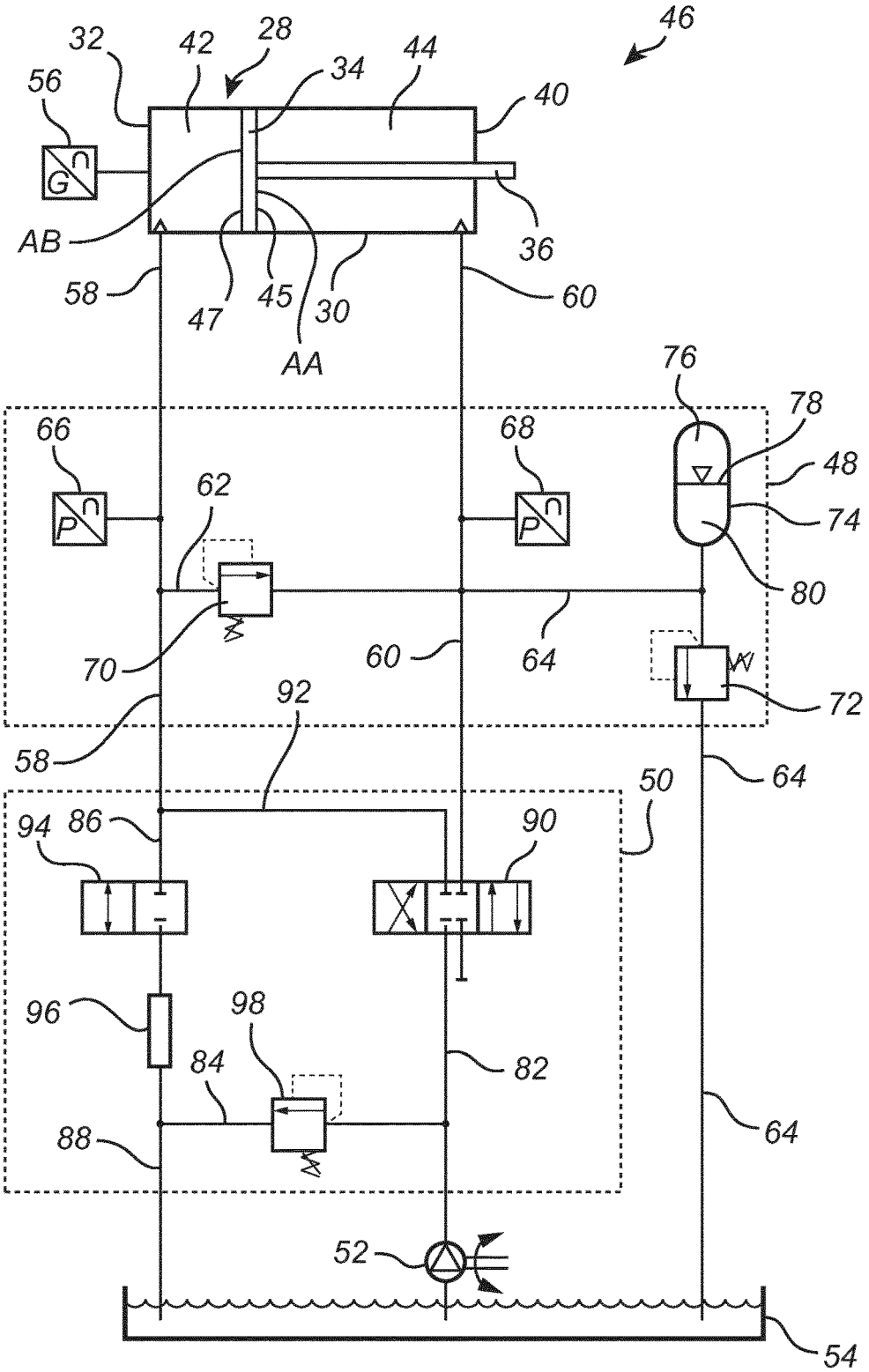
FIG. 2 is a schematic illustration of a hydraulic control system of the jaw crusher of FIG. 1.

FIG. 2 is a schematic illustration of a hydraulic control system 46 of the jaw crusher 1 of FIG. 1. The hydraulic control system 46 comprises, as its main components, the double-acting hydraulic cylinder 28, a pressure control system 48, a hydraulic fluid supply control system 50, a hydraulic fluid supply pump 52, and a hydraulic fluid tank 54. The hydraulic fluid may typically be a suitable type of hydraulic oil, but the hydraulic fluid may also be another type of fluid, including other types of oil, suitable gases, water etc. Typically the hydraulic fluid is a liquid, preferably hydraulic oil. The hydraulic fluid tank 54 would typically be at or close to atmospheric pressure.

The double-acting hydraulic cylinder 28 comprises, as described hereinbefore with reference to FIG. 1, the piston 34, which is connected to the movable jaw 2 via the piston rod 36, and a position measuring device 56 which measures the position of the piston 34. The piston 34 separates the bore side space 42 from the annular side space 44. Hence, the piston rod 36 and the annular side space 44 are arranged on a first side 45 of the piston 34, and the bore side space 42 is arranged on a second side 47, opposite to the first side 45, of the piston 34. The amount of hydraulic fluid supplied to the bore side space 42 and to the annular side space 44 determines the position of the movable jaw 2, i.e., determines the closed side setting of the jaw crusher 1.

The pressure control system 48 is arranged for controlling the pressure in the bore side space 42 and in the annular side space 44 and comprises a bore side space supply pipe 58 fluidly connected to the bore side space 42, an annular side space supply pipe 60 fluidly connected to the annular side space 44, an overpressure transfer pipe 62, and a first drain pipe 64. The overpressure transfer pipe 62 connects the bore side space 42 to the annular side space 44, via the bore side space supply pipe 58 and the annular side space supply pipe 60. The drain pipe 64 connects the annular side space 44 to the tank 54, via the annular side space supply pipe 60.

A bore side pressure sensor 66 is arranged in the pipe 58 for measuring the pressure of hydraulic fluid in the bore side space 42. An annular side pressure sensor 68 is arranged in the pipe 60 for measuring the pressure of hydraulic fluid in the annular side space 44.

The pressure control system 48 further comprises a maximum load pressure relief valve 70 and an annular side pressure relief valve 72. The maximum load pressure relief valve 70 is arranged in the overpressure transfer pipe 62 and has a relief setting of, for example, a first predetermined pressure of 400 bar(a). Relief of the pressure in the bore side space 42 may be necessary to avoid damage to the jaw crusher 1 when uncrushable objects, such as so-called tramp material, enter the crusher 1. When the pressure in the bore side space 42 exceeds the relief setting of the maximum load pressure relief valve 70 the relief valve 70 opens and hydraulic fluid is drained from the bore side space 42 via the fluidly connected bore side space supply pipe 58 and the overpressure transfer pipe 62, with the relief valve 70, to the annular side space supply pipe 60. As an effect of the opening of the relief valve 70 the amount of hydraulic fluid in the bore side space 42 is reduced, and the piston 34 moves in the direction of the cylinder base cap 32, such that the piston rod 36, the piston rod head member 38, the toggle beam 22, the toggle plate 20 and the movable jaw 2 may move away from the stationary jaw 4 to allow the uncrushable object/-s to move out of the crushing chamber 18 illustrated in FIG. 1. An opening of the relief valve 70 may generally be referred to as a "tramp relief event". During normal crushing operation, the relief valve 70 is closed, and there is no fluid contact between the bore side space 42 and the annular side space 44.

The annular side pressure relief valve 72 is arranged in the drain pipe 64 and has a relief setting of, for example, a second predetermined pressure of 20 bar(a). The annular side pressure relief valve 72 sets the maximum pressure of the hydraulic fluid in the annular side space 44. The relief setting of the maximum load pressure relief valve 70 is higher than the relief setting of the annular side pressure relief valve 72. Typically, the relief setting of the maximum load pressure relief valve 70 is a factor of at least 5, typically a factor which is in the range of 10 to 40, higher than the relief setting of the annular side pressure relief valve 72. These factors set a preferred upper limit for the relief setting of the annular side pressure relief valve 72 that should preferably not be exceeded, because an unduly high relief setting of the annular side pressure relief valve 72 means that the pressure of the annular side space 44 unduly counteracts, during the crushing cycle, the pressure of the bore side space 42, thereby reducing the crushing force. On the other hand, the relief setting of the annular side pressure relief valve 72 should also be sufficiently high to ensure that the hydraulic fluid of the annular side space 44 presses the piston 34 against the hydraulic fluid of the bore side space 42 also during the retraction cycle during which the movable jaw 2 is retracted from the stationary jaw 4. Hence, the hydraulic fluid of the annular side space 44 should result in a pressing force acting on the piston 34 also during the retraction cycle when the piston 34 contracts the hydraulic fluid of the annular side space 44. This requirement sets a preferred lower limit for the relief setting of the annular side pressure relief valve 72. Typically, the lower limit would correspond to a relief setting of the annular side pressure relief valve 72 of 3-10 bar(a), depending on the weight and the design of the movable jaw 4, and on an area AA of the piston 34 at the first side 45 thereof.

Hence, the pressure relief setting of the annular side pressure relief valve 72 may preferably be in the range of 3 to 50 bar(a), more preferably 5 to 40 bar(a), and most preferably 10 to 30 bar(a).

When the maximum load pressure relief valve 70 has opened, due to the pressure in the bore side space 42 exceeding the relief setting of the relief valve 70, the hydraulic fluid entering the annular side space supply pipe 60 will be forwarded to the annular side space 44 until the pressure exceeds the relief pressure of the annular side pressure relief valve 72. As described hereinbefore, a tramp relief event causes a reduction of the amount of hydraulic fluid in the bore side space 42, and a movement of the piston 34 in the direction of the cylinder base cap 32. Such movement of the piston 34 causes a reduction in the volume of the bore side space 42, but also an increase in the volume of the annular side space 44. The forwarding of hydraulic fluid from the bore side space 42 to the annular side space 44, via the overpressure transfer pipe 62, compensates for the increased volume of the annular side space 44, and reduces the risk of cavitation problems due to a formation of vacuum in the annular side space 44. When the pressure exceeds the relief pressure of the annular side pressure relief valve 72 the valve 72 will open and the hydraulic fluid will be drained from the annular side space supply pipe 60 and further to the tank 54 via the fluidly connected drain pipe 64. Thereby, at least a portion of the hydraulic fluid drained from the bore side space 42 will be transferred to the annular side space 44, and the remainder, if any, of the hydraulic fluid drained from the bore side space 42 will be drained to the tank 54.

The piston rod 36 has a certain diameter, and takes up a certain area of the first side 45 of the piston 34. This means that the hydraulic fluid of the annular side space 44 acts on an area AA which is smaller than an area AB on which the hydraulic fluid of the bore side space 42 acts. Typically, the area AA of the first side 45 of the piston 34 will be 40-80%, more typically 50-80%, of the area AB of the second side 47 of the piston 34. The piston rod 36 also takes up a certain portion of the volume of the annular side space 44. Thereby, if the piston 34 moves a distance X towards the cylinder base cap 32 the volume of the bore side space 42 will decrease by Y $dm^3$, while the volume of the annular side space 44 at the same time increases by 40-80%, more typically 50-80%, of the volume Y. Hence, in the above described tramp release event 40-80%, more preferably 50-80%, of the hydraulic fluid pressed out of the bore side space 42 is received in the annular side space 44, and only the remaining 20-60%, preferably only 20-50%, of the hydraulic fluid pressed out of the bore side space 42 is directed to the hydraulic fluid tank 54. This makes retraction of the movable jaw 2 quicker during, for example, a tramp release event, since the hydraulic fluid can be more quickly evacuated from the bore side space 42, and it also reduces oil splashing in the tank 54 caused by the tramp release event.

The pressure control system 48 further comprises an annular side space accumulator 74. The annular side space accumulator 74 is fluidly connected to the drain pipe 64, upstream of the annular side pressure relief valve 72, and is fluidly connected, via the drain pipe 64 and the annular side space supply pipe 60, to the annular side space 44. The accumulator 74 has a gas compartment 76, a diaphragm 78, and a fluid compartment 80. When the hydraulic fluid is a liquid the latter compartment would be a liquid compartment 80. The gas compartment 76 is pre-compressed to a pressure which is lower than the relief pressure of the annular side pressure relief valve 72. By "pre-compressed" is meant that the gas compartment 76 is filled with a gas, such as nitrogen, argon, air, or any other suitable gas, of a certain pressure prior to any liquid entering the accumulator 74. Preferably, the pre-compression pressure of the gas compartment 76 is 25-75%, more preferably about half, of the pressure relief setting of the annular side pressure relief valve 72. Hence, if the pressure relief setting of the annular side pressure relief valve 72 is, for example, 20 bar(a) then the pre-compression pressure of the gas compartment 76 is preferably in the range of 5 to 15 bar(a). For example, the pre-compression pressure of the gas compartment 76 may be about 10 bar(a). In operation the pressure of the annular side space 44 is controlled by the relief pressure of the annular side pressure relief valve 72, to, in this example, 20 bar(a). Hence, in operation the pressure in the accumulator 74 gas compartment 76, as well as in the liquid compartment 80, is close to 20 bar(a), and the gas compartment 76 and the liquid compartment 80 each take up about half of the total volume of the accumulator 74 at such pressure. The liquid compartment 80 of the annular side space accumulator 74 is in fluid contact with the annular side space 44 during operation of the jaw crusher 1 and ensures that there is always pressurized hydraulic fluid in the annular side space 44, pressing the piston 34 towards the hydraulic fluid in the bore side space 42.

The liquid compartment 80 of the annular side space accumulator 74 has, preferably, a volume, at a fluid pressure in the annular side space accumulator 74 which is two times the pre-compression pressure of the gas compartment 76 of the accumulator 74, of 1 to 20%, more preferably 2 to 10%, of the maximum hydraulic fluid volume of the bore side space 42. Hence, for example, if the pre-compression pressure of the gas compartment 76 is 10 bar(a), at which pressure the accumulator 74 contains no hydraulic fluid, then the liquid compartment 80 should contain, at a pressure of 2×10=20 bar(a) in the liquid compartment 80, and the same pressure in the gas compartment 76, a hydraulic fluid volume which would be 1 to 20% of the maximum hydraulic fluid volume of the bore side space 42. If, for example, the maximum hydraulic fluid volume in the bore side space 42 is 5000 $cm^3$, then it is preferred that the liquid compartment 80 would contain, at the pressure being twice the pre-compression pressure, at least 5000*0.01=50 $cm^3$ of hydraulic fluid, and need not contain more than 5000*0.20=1000 $cm^3$ of hydraulic fluid. It will be appreciated that it is possible to arrange, as alternative to one accumulator 74, two, three or more accumulators fluidly connected to the drain pipe 64. In such a case the sum of the fluid volumes of the liquid compartments of these accumulators would preferably be 1 to 20% of the maximum hydraulic fluid volume of the bore side space 42.

During normal operation of the jaw crusher 1 the pressure control system 48 functions independently of the hydraulic fluid supply control system 50. The hydraulic fluid supply control system 50 functions to supply hydraulic fluid to the pressure control system 48 and to the hydraulic cylinder 28 before start up of the jaw crusher 1, at re-setting of the jaw crusher 1 to the previous closed side setting after a tramp release event, and when the position of the movable jaw 2 is to be adjusted to compensate for wear of the wear plates 10, 12, or to adjust the closed side setting to a new value.

The hydraulic fluid supply control system 50 comprises a hydraulic fluid supply pipe 82, a pump over pressure relief pipe 84, a hydraulic fluid return pipe 86, and a second drain pipe 88. The hydraulic fluid supply pipe 82 is fluidly connected to the pump 52 and is arranged for receiving hydraulic fluid pumped by the pump 52 from the tank 54.

A first control valve 90 is connected to the hydraulic fluid supply pipe 82. In a first mode, which is shown in FIG. 2, the first control valve 90 blocks any contact between the hydraulic fluid supply pipe 82 and the pressure control system 48. This is the normal setting of the first control valve 90 when the jaw crusher 1 is in operation, and the desired amounts of hydraulic fluid are present in the bore side space 42 and the annular side space 44. In a second mode the first control valve 90 opens a connection between the hydraulic fluid supply pipe 82 and the bore side space supply pipe 58, via an intermediate supply pipe 92. This would be the setting when hydraulic fluid is to be added to the bore side space 42, for example, when re-setting the crusher 1 to the previous closed side setting after a tramp release event, or when decreasing the closed side setting. In a third mode of operation the first control valve 90 opens a connection between the hydraulic fluid supply pipe 82 and the annular side space supply pipe 60. This would be the setting when hydraulic fluid is to be added to the annular side space 44, for example, when increasing the closed side setting.

A second control valve 94 is connected to the hydraulic fluid return pipe 86. In a first mode, which is shown in FIG. 2, the second control valve 94 blocks any contact between the second drain pipe 88 and the pressure control system 48. This is the normal setting of the second control valve 94 when the crusher 1 is in operation, and the desired amounts of hydraulic fluid are present in the bore side space 42 and the annular side space 44. In a second mode the second control valve 94 opens a connection between the bore side space supply pipe 58 and the hydraulic fluid return pipe 86 and further to the second drain pipe 88. This would be the setting when hydraulic fluid is to be drained from the bore side space 42 and back to the tank 54, via the pipes 58, 86 and 88, when, for example, increasing the closed side setting. The hydraulic fluid return pipe 86 may, optionally, be provided with a constant flow valve 96 to even out the flow of hydraulic fluid when draining hydraulic fluid from the bore side space 42.

A maximum pump pressure relief valve 98 may be arranged in the pump over pressure relief pipe 84 to avoid too high pressures in the fluid supply control system 50 when the first control valve 90 is in its first, closed, mode. The maximum pump pressure relief valve 98 may have a relief setting corresponding to the maximum allowed pump pressure of the pump 52. When the pressure in the hydraulic fluid supply pipe 82 exceeds the relief setting of the maximum pump pressure relief valve 98 the relief valve 98 opens and hydraulic fluid is drained back to the tank 54 via the fluidly connected hydraulic fluid supply pipe 82, the pressure relief pipe 84 and the second drain pipe 88.

The manner in which the jaw crusher 1 is controlled by the hydraulic control system 46 will now be described with reference to FIGS. 1 and 2.

In a starting position the bore side space 42 and the annular side space 44 of the hydraulic cylinder 28 contain hydraulic fluid that is almost at atmospheric pressure, i.e. at about 1 bar(a). The pump 52 is started and the valve 90 is set to its third mode of operation and opens a connection between the hydraulic fluid supply pipe 82, the annular side space supply pipe 60 and the annular side space 44. Hydraulic fluid is supplied to the annular side space 44 until the annular side pressure relief valve 72 opens at, for example, a pressure of 20 bar(a). When the relief valve 72 opens the pressure in the annular side space 44 is at its desired value, and the annular side space accumulator 74, which is in fluid contact with the annular side space 44, has been pressurized to its desired working pressure. Then the valve 90 is set to its second mode and opens a connection between the hydraulic fluid supply pipe 82, the bore side space supply pipe 58 and the bore side space 42. Hydraulic fluid is supplied to the bore side space 42 until the piston 34 reaches a desired position, as measured by the position measuring device 56, which corresponds to a desired closed side setting of the jaws 2, 4. Then the valve 90 moves to its first mode, meaning that the hydraulic fluid contact between the hydraulic fluid supply control system 50 and the pressure control system 48 has been blocked.

Crushing is now started by rotating the flywheel 8 and the eccentric shaft 6. During the crushing cycle of the jaw crusher 1, i.e., when the movable jaw 2 moves towards the stationary jaw 4, crushing forces are transferred from the movable jaw 2 to the piston rod 36, via the toggle plate 20, the toggle beam 22, and the piston rod head member 38, and will be taken up by hydraulic fluid contained in the bore side space 42 as the piston rod 36 presses the piston 34 in the direction of the cylinder base cap 32. The pressure in the bore side space 42 may, during the crushing cycle, increase up to, for example, 300 bar(a). Such high pressures in the bore side space 42 causes a compression of the hydraulic fluid, and hence a volume reduction, since the hydraulic fluid is a somewhat compressible medium. For example, the volume of hydraulic oil could be reduced by 2-5% when compressing the hydraulic oil from atmospheric pressure, i.e., about 1 bar(a), and up to 300 bar(a). Due to the annular side space accumulator 74 such compression of the hydraulic fluid in the bore side space 42 will not cause an under-pressure in the annular side space 44, since the annular side space accumulator 74 ensures that the hydraulic fluid in the annular side space 44 is under a positive pressure, i.e., a pressure above 1 bar(a), and is pressed against the piston 34 also during a compression, and volume reduction, of the hydraulic fluid in the bore side space 42.

During the retraction cycle of the jaw crusher 1, i.e., when the movable jaw 2 moves away from the stationary jaw 4, the high pressure in the bore side space 42 will be transferred to a low pressure, as the movable jaw 2 is retracted from the stationary jaw 4 by the hydraulic cylinder 28. During the retraction cycle the pressure in the annular side space 44 will assist in retracting the movable jaw 2, and will ensure that the piston 34 is at all times pressed against the hydraulic fluid in the bore side space 42, such that under-pressure in the bore side space 42 is prevented from occurring during the retraction cycle. Hence, the accumulator 74 with its pre-compressed gas compartment 76, ensures that the hydraulic fluid in the annular side space 44 is always under pressure, typically a pressure which is in the range of 10-20 bar(a), even in situations of compression and volume reduction of the hydraulic fluid in the bore side space 42, and in situations of retracting the movable jaw 2. Thereby, the piston 34 is always pressed between hydraulic fluid in the bore side space 42 and hydraulic fluid in the annular side space 44, with no risk of under-pressure being formed on either side, such under-pressures that might, in the prior art jaw crushers, cause severe problems with cavitation and damage to piston sealings.

The liquid compartment 80 contains a volume of hydraulic fluid that is more than sufficient for compensating for the compression of the volume of the hydraulic fluid of the bore side space 42, during the crushing cycle of the jaw crusher 1, and for compensating for the minor leakages of hydraulic fluid that may occur from the bore side space 42, the annular space 44, and the pipes and valves fluidly connected thereto. Since the liquid compartment 80 is held under pressure, from the gas compartment 76, such compensations will be fully automatic, and will not need any measurement and only a minimum of surveillance. In case there would be large leakages of hydraulic fluid during operation of the jaw crusher 1, such would be detected by the annular side pressure sensor 68 as a reduced pressure. If the pressure measured by the sensor 68 would drop below, for example, 15 bar(a), then the pump 52 may be started to supply hydraulic fluid, via pipes 82 and 60, to the annular side space 44 until the pressure reaches the relief setting, for example 20 bar(a), of the annular side pressure relief valve 72, in accordance with, for example, the principles disclosed hereinabove.

If it is desired to reduce the closed side setting during operation of the crusher 1 the pump 52 is started and the valve 90 is set to its second mode and opens a connection between the hydraulic fluid supply pipe 82, the intermediate supply pipe 92, the bore side space supply pipe 58 and the bore side space 42. Hydraulic fluid is pressed into the bore side space 42 and forces the piston 34 to move towards the cylinder front cap 40. As an effect of such movement, the volume available in the annular side space 44 is reduced, the pressure increases, the annular side pressure relief valve 72 opens, and hydraulic fluid is drained from the annular side space 44 to the tank 54, via the pipes 60 and 64, and the valve 72. When a desired position of the piston 34 has been reached, as measured by the position measuring device 56, the valve 90 returns to its first mode and the pump 52 is stopped. The relief valve 72 closes, and hydraulic fluid at the desired pressure, e.g. 20 bar(a), is retained in the annular side space 44.

If it is desired to increase the closed side setting during operation of the crusher 1 the pump 52 is started and the valve 90 is set to its third mode and opens a connection between the hydraulic fluid supply pipe 82, the annular side space supply pipe 60 and the annular side space 44. The second control valve 94 is set to its second mode to open a connection between the bore side space 42, the bore side space supply pipe 58, the hydraulic fluid return pipe 86, the second drain pipe 88 and further to the tank 54. Hydraulic fluid is drained from the bore side space 42 to the tank 54, via the pipes 58, 86, and 88, optionally via the constant flow valve 96, and, simultaneously, hydraulic fluid is pressed into the annular side space 44 and forces the piston 34 to move towards the cylinder base cap 32. When a desired position of the piston 34 has been reached, as measured by the position measuring device 56, the valve 94 returns to its first mode and ends the drain of hydraulic fluid from the bore side space 42. Hydraulic pressure is thereby increased in the annular side space 44 until the relief valve 72 opens. Then the valve 90 is returned to its first mode and the pump 52 is stopped. Hence, hydraulic fluid at the desired pressure, e.g. 20 bar(a), is retained in the annular side space 44.

In the event that an un-crushable object enters the crushing chamber 18 the pressure in the bore side space 42 will increase to above the relief pressure of the maximum load pressure relief valve 70. Thereby the maximum load pressure relief valve 70 will open, in a tramp release event, and will allow hydraulic fluid to drain from the bore side space 42, such that the piston 34 may move towards the cylinder base cap 32. The hydraulic fluid draining from the bore side space 42 will, via pipes 58, 62 and 64 reach the annular side pressure relief valve 72. As long as the pressure in the pipe 64 is below the relief pressure of the valve 72, the hydraulic fluid draining from the bore side space 42 will flow, via the pipes 58, 62 and 60, into the annular side space 44 to compensate for the fact that the volume of the annular side space 44 increases as the piston 34 moves towards the cylinder base cap 32. If the pressure in the annular side space 44 exceeds the relief pressure of the relief valve 72 the relief valve 72 opens and drains the surplus hydraulic fluid to the tank 54, via the pipe 64. Hence, at least a portion, preferably 40-80%, and more preferably 50-80%, of the hydraulic fluid draining from the bore side space 42 during the tramp release event is forwarded to the annular side space 44. The pressure in the annular side space 44 is, due to the relief valve 72, maintained at the desired pressure during the entire tramp release event. Thereby under-pressure in the annular side space 44 during the tramp release event is avoided. When the un-crushable object has moved out of the crushing chamber 18 the relief valve 70 is closed, and the annular side space 44 is at its desired pressure, e.g. 20 bar(a) and crushing may begin almost immediately. If it would be desired to return to the closed side setting upheld prior to the tramp release event, the valve 90 could be set to its second mode to move the piston 34 towards the cylinder front cap 40 to decrease the closed side setting in accordance with the method of decreasing the closed side setting described hereinbefore.

It will be appreciated that numerous modifications of the embodiments described above are possible within the scope of the appended claims.

Hereinbefore it has been described that the hydraulic control system 46 comprises one hydraulic cylinder 28. It will be appreciated that the hydraulic control system 46 may comprise more than one hydraulic cylinder 28. In particular if the jaw crusher has a wide design, two, three, or more parallel hydraulic cylinders 28 may be arranged for controlling the position of the movable jaw 2. In cases of the jaw crusher 1 comprising more than one hydraulic cylinder 28, for example two to four parallel hydraulic cylinders 28 controlling the position of the movable jaw 2, then the bore side spaces 42 of all those parallel hydraulic cylinders 28 should preferably be fluidly connected to each other, such that the pressure is the same in all of the bore side spaces 42, and the annular side spaces 44 of all those parallel hydraulic cylinders 28 should preferably be fluidly connected to each other, such that the pressure is the same in all of the annular side spaces 44. With several parallel hydraulic cylinders 28 it would be preferable to arrange one or several annular side space accumulator/-s 74 that have a total fluid volume, at two times the pre-compression pressure, of 1 to 20%, more preferably 2 to 10%, of the total maximum fluid volume of all the bore side spaces 42 of those parallel hydraulic cylinders 28.

Hereinbefore it has been described that the jaw crusher hydraulic system and the method of the present invention are applied to a jaw crusher 1 in which the hydraulic cylinder 28 acts on the movable jaw 2 via the toggle beam 22 and the toggle plate 20. It will be appreciated that the jaw crusher hydraulic system and the method of the present invention may also be applied to other types of jaw crushers. For example, the jaw crusher hydraulic system and the method may be applied to jaw crushers of the type in which the hydraulic cylinder itself has the added function of being also a toggle plate, and acts more or less directly on the movable jaw. Examples of the latter type of jaw crusher are illustrated in US 2003/0132328, mentioned hereinbefore, and also in U.S. Pat. No. 4,927,089.

The invention claimed is:

1. A jaw crusher hydraulic system for controlling the position of a movable jaw of a jaw crusher, the hydraulic system comprising:

at least one hydraulic cylinder having a piston including a piston rod arranged on a first side of the piston for positioning the movable jaw, the hydraulic cylinder including a bore side space arranged on a second side of the piston, which is opposite to the first side of the piston, arranged to contain a hydraulic fluid taking up crushing forces exerted by the movable jaw on the piston rod during a crushing cycle of the jaw crusher, and an annular side space arranged on the first side of the piston for containing a hydraulic fluid pressing the piston against hydraulic fluid of the bore side space;

an annular side space accumulator having a fluid compartment in fluid contact with the annular side space;

a transfer pipe fluidly connecting the bore side space to the annular side space;

a gas compartment arranged for containing a pressurized gas to apply a pressure on the hydraulic fluid in the annular side space; and a maximum load pressure relief valve arranged in the transfer pipe to open a connection from the bore side space to the annular side space when a first predetermined pressure of the hydraulic fluid in the bore side space is exceeded; wherein the accumulator is fluidly connected between the annular side space and the maximum load pressure relief valve.

2. A hydraulic system according to claim 1, wherein a drain pipe fluidly connects the annular side space to a hydraulic fluid tank.

3. A hydraulic system according to claim 2, wherein an annular side pressure relief valve is arranged in the drain pipe to open a connection from the annular side space to the hydraulic fluid tank when a second predetermined pressure of the hydraulic fluid in the annular side space is exceeded.

4. A hydraulic system according to claim 3, wherein a pressure relief setting of the maximum load pressure relief valve is at least a factor 5 higher than a pressure relief setting of the annular side pressure relief valve.

5. A hydraulic system according to claim 3, wherein the pressure relief setting of the annular side pressure relief valve is in the range of 3 to 50 bar(a).

6. A hydraulic system according to claim 3, wherein the pressure relief setting of the annular side pressure relief valve is in the range of 5 to 40 bar(a).

7. A hydraulic system according to claim 1, wherein the fluid compartment of the annular side space accumulator has a volume, at a fluid pressure in the annular side space accumulator which is two times the pre-compression pressure of the gas compartment of the annular side space accumulator, of 1 to 20% of the maximum hydraulic fluid volume of the bore side space.

8. A method of controlling the position of a movable jaw of a jaw crusher including at least one hydraulic cylinder having a piston including a piston rod arranged on a first side of the piston for positioning the movable jaw, comprising the steps of:

supplying hydraulic fluid to a bore side space arranged on a second side of the piston, which is opposite to the first side of the piston, to take up crushing forces exerted by the movable jaw on the piston rod during a crushing cycle of the jaw crusher;

supplying hydraulic fluid to an annular side space arranged on the first side of the piston to press the piston against the hydraulic fluid of the bore side space;

applying a pressure to the hydraulic fluid of the annular side space by an annular side space accumulator having a gas compartment containing a pressurized gas and a fluid compartment in fluid contact with the annular side space; and transferring hydraulic fluid from the bore side space through a maximum load pressure relief valve to the annular side space when the pressure of the hydraulic fluid in the bore side space exceeds a first predetermined pressure; wherein the accumulator is fluidly connected between the annular side space and the maximum load pressure relief valve.

9. A method according to claim 8, further comprising transferring hydraulic fluid from the bore side space to the annular side space when an uncrushable object has been fed to the jaw crusher.

10. A method according to claim 8, further comprising transferring hydraulic fluid from the annular side space to a hydraulic fluid tank when the pressure in the annular side space exceeds a second predetermined pressure.

11. A method according to claim 10, wherein the second predetermined pressure at which hydraulic fluid is transferred from the annular side space to the hydraulic fluid tank is in the range of 3 to 50 bar(a).

12. A method according to claim 10, wherein hydraulic fluid is supplied to the annular side space until the pressure in the annular side space is equal to the second predetermined pressure, prior to starting operation of the jaw crusher.

13. A method according to claim 10, wherein a pre-compression pressure of the gas compartment of the annular side space accumulator is lower than the second predetermined pressure, the pre-compression pressure of the gas compartment being 25-75% of the second predetermined pressure.

14. A method according to claim 10, wherein the second predetermined pressure at which hydraulic fluid is transferred from the annular side space to the hydraulic fluid tank is in the range of 5 to 40 bar(a).

15. A method according to claim 8, wherein the first predetermined pressure at which hydraulic fluid starts to be transferred from the bore side space to the annular side space is a factor of at least 5 higher than the second predetermined pressure at which hydraulic fluid starts to be transferred from the annular side space to the hydraulic fluid tank.

16. A method according to claim 8, wherein 40-80% of an amount of hydraulic fluid leaving the bore side space is received in the annular side space.

* * * * *